United States Patent [19]

Yen

[11] Patent Number: 4,470,508

[45] Date of Patent: Sep. 11, 1984

[54] DUSTFREE PACKAGING CONTAINER AND METHOD

[75] Inventor: Yung-Tsai Yen, Los Altos, Calif.

[73] Assignee: Micro Lithography, Inc., Santa Clara, Calif.

[21] Appl. No.: 524,855

[22] Filed: Aug. 19, 1983

[51] Int. Cl.[3] ..... B65D 85/02; B65D 85/30; B65D 81/24

[52] U.S. Cl. ..... 206/334; 206/303; 206/447; 206/460; 206/813

[58] Field of Search ..... 206/334, 328, 329, 332, 206/303, 447, 460, 813

[56] References Cited

U.S. PATENT DOCUMENTS

| | | | |
|---|---|---|---|
| 769,915 | 9/1904 | Nostrand | 206/447 |
| 1,012,382 | 12/1911 | Lundbeck | 206/447 |
| 2,018,005 | 10/1935 | Barnby | 206/813 |
| 2,165,539 | 7/1939 | Dahlgren | 206/813 |
| 3,080,964 | 3/1963 | Robinson et al. | 206/303 |
| 3,082,453 | 3/1963 | Mutchler et al. | 206/447 |
| 3,668,658 | 6/1972 | Flores et al. | 206/303 |
| 4,053,049 | 10/1977 | Beauvais | 206/460 |
| 4,209,091 | 6/1980 | Lieberman | 206/460 |
| 4,298,120 | 11/1981 | Kaneko et al. | 206/460 |

*Primary Examiner*—William T. Dixson, Jr.
*Attorney, Agent, or Firm*—Michael J. Hughes

[57] ABSTRACT

A dust and contamination free packaging container is provided. A method of producing contamination free packaging is also included. The package includes mating exterior frame members and spacing blocks for displacing a packaged product from the interior walls of the frame. The interior frame surfaces are coated with a contact adhesive which captures and retains particulate matter with which it comes into contact. Prior to use the contact adhesive surfaces are protected by cover sheets or elements which are readily removed at the time the product is to be inserted into the container. The predominant usage of the containers and method is in the electronic and optical industries and particularly in the packaging of photomask pellicles.

19 Claims, 2 Drawing Figures

DUSTFREE PACKAGING CONTAINER AND METHOD

TECHNICAL FIELD

The present invention relates generally to packaging containers for shipment and storage and more specifically to packaging in which particulate contamination is designed to be minimized. The predominant current usage of the present invention relates to prevention of dust contamination of surfaces of products, particularly in the electronic and optical fields.

BACKGROUND ART

Protective packaging of materials and products has been practiced since time immemorial. There has always been a need to prevent contamination and damage to products being stored or transported. However, the needs for protective packaging in recent years have become ever more stringent.

The electronics industry, in particular, has made increasing demands upon the quality of packaging of various components utilized in manufacture and also regarding finished product shipping. The microminiature aspects of the components utilized in the modern electronics field have made it possible for a very small amount of contamination to cause significant problems. Therefore, any contamination at all must be carefully avoided.

One improvement in modern electronics packaging, as compared to conventional packaging, is the use of entirely non-shedding packaging materials. Plastics such as polyurethane, polyethelene and other massive molecular structure compositions have been utilized to minimize the opportunity for contamination of the product by particles separating from the packaging material itself. Furthermore, the actual packing of products takes place under extremely well controlled conditions and in a totally contamination-free environment. However, even the best of conditions and materials still allow for some slight possibility of particulate contamination.

To date, no entirely satisfactory means of packaging has been introduced which, for all intents and purposes eliminates particulate contamination as well as satisfying the other requirements of industry-acceptable packaging. These requirements include economical manufacture, ease of use, low weight, resistance to degradation under electronic equipment conditions, stackability, and aesthetic qualities.

DISCLOSURE OF INVENTION

Accordingly, it is an object of the present invention to provide a contamination free package for electronic and optical equipment shipping and storage which prevents particulate contamination to the surface of the articles.

It is another object of the present invention to provide a method for adapting existing packaging to minimize particulate contamination.

It is a further object of the present invention to provide a dustless package which is capable of fulfilling all of the packaging selection parameters commonly utilized in the electronics and optical industries.

The present invention is a contamination free package and a method of providing contamination free packages for totally protecting the exterior surfaces of products or components from particulate contamination during transport and storage. The invention is especially adapted for use with optical and electronic products. A particular usage is in packaging for shipment and storage of photomask pellicles.

Briefly, the preferred embodiments of the present invention are a method of producing a dustless package and the dustless package produced thereby. The method includes placing a layer of adhesive material on the interior surface of a package or container at points which do not come into direct physical contact with the article being shipped. The adhesive layer is then provided with a peelable cover sheet having a non-adhesive exterior side. The cover sheet is installed upon the adhesive layer in such a manner that it may be easily removed when it is desired to expose the adhesive.

The preferred embodiment of a package according to the method of the current invention is a generalized packaging box utilized for transport and storage of articles. The generalized box is provided with spacer blocks or rings upon which the article is supported. In this manner, the surfaces of the article are separated from the interior wall surfaces of the container over a significant portion of the interior of the package. The non-contacting exposed surfaces of the container are then provided with a layer of contact adhesive. The layer is then provided with a peelable protective cover.

When the dustless package is to be utilized it is delivered to a sealed contamination free environment in conjunction with the article to be shipped. The package is then cleaned by conventional means such as dust blasting by air or water jets and is ready for use. At the time that the package is ready for use, the peelable covers are removed and the contact adhesive surfaces are exposed. The article is then placed in the container such that it is supported on the spacer blocks or rings and an air space exists between the article and the adhesive surfaces. The adhesive surfaces then capture and retain particulate matter coming in contact with the adhesive and prevent the particulate matter from contaminating the surface of the article.

An advantage of the present invention is that it significantly improves the minimization of particulate contamination to the surface of articles shipped.

Another advantage of the present invention is that it is readily adapted to conventional shipping containers.

A further advantage of the present invention is that it is extremely economical to implement.

It is still another advantage of the present invention that the adhesive surfaces of the package may be maintained and protected up until the time that they are exposed, by peeling the covers, to protect the article.

Yet another advantage of the present invention is that the freshly peeled adhesive layer presents a contamination free surface.

These and other objects and advantages of the present invention will become clear to those skilled in the art in light of the description of the best presently known mode of carrying out the invention and the industrial applicability of the preferred embodiment as described herein and as illustrated in the several figures of the drawing.

BEST MODE OF CARRYING OUT INVENTION

The present invention is a method of providing a dustless contamination free container for transport and storage of articles. The dustless package is particularly utilized to protect the surfaces of optical and electronic components from contamination during shipment and storage. A particularly important usage of the method of the present invention is to protect the surface of photomask pellicle films.

Figure 1:
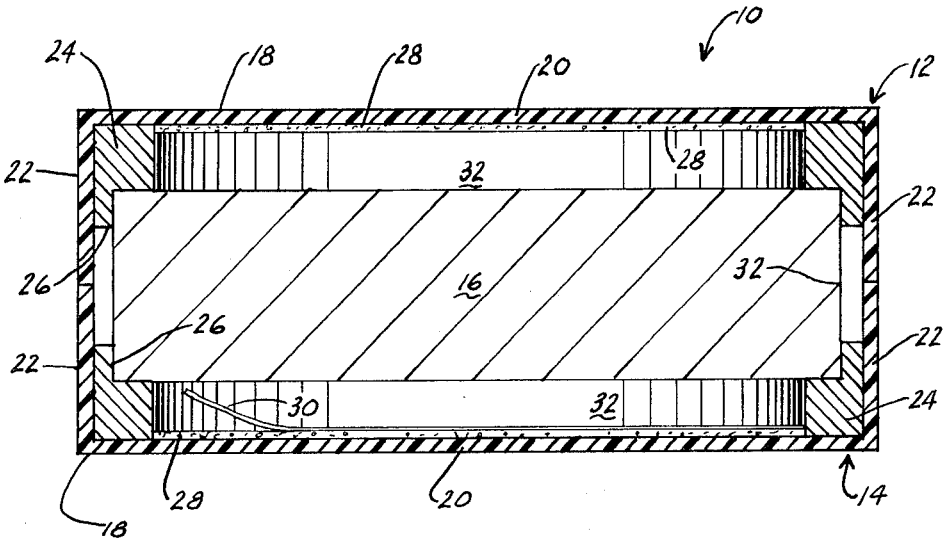
FIG. 1 is a longitudinal cross sectional view of a dustless package according to the method of the present invention.

A dustless container according to the method of the present invention is shown in a longitudinal cross-sectional view in FIG. 1 and is designated by the general reference character 10. Although the method of the present invention is adaptable to containers of all sizes and shapes, the idealized dustless container 10 illustrated in FIG. 1 is shown as having an upper member 12 and a lower member 14 which is symmetrical about a horizontal plane with the upper member 12. The container 10 is also shown as enclosing a generalized article or product 16.

As is shown in FIG. 1, the idealized dustless container 10 has a rectangular longitudinal cross section. The upper member 12 and the lower member 14 both include a continuous integral exterior frame 18 which prevents the intrusion of matter from the outside environment to the interior of the container 10.

The exterior frame 18 includes lateral panels 20 on the top surface and the bottom surface of the container 10. Lateral panels 20 have planar surfaces on the interior of the container 10. The exterior frame 18 further includes longitudinal panels 22 which are formed integrally with the lateral panels 20 complete with frame. The shape of the longitudinal panels 22 is dependent upon the shape of the article 16 to be contained. In the case of a photomask pellicle package the longitudinal panels 22 will be curved so as to form a circular container 10 and will have only the height required to create an effective container.

The interior of the container 10 is provided with spacer blocks 24 to support the article 16 in such a position that it does not come into contact with the interior surface of the lateral panels 20. In the preferred embodiment, each spacer block 24 includes an extension in the nature of spacer ledge 26 which further supports the article 16 and prevents it from contacting the longitudinal panels 22.

The interior planar surface of the lateral panels 20 is provided with a layer of contact adhesive 28. The adhesive layer 28 is uniform over the entire interior surface of each lateral panel 20 to the extent that there is no exposed section of the lateral panel 20 which is not covered by the adhesive 28. The thickness of the adhesive layer 28 is sufficient to provide a continuous viable adhesive surface.

In some preferred embodiments the adhesive layer 28 is also applied to the exposed interior surfaces of the longitudinal panels 22. This application protects the side surfaces of the article 16 from contamination. However, in the embodiment shown, the article 16 is such that the side surfaces are less significant, such as with a pellicle, and it is less desirable to provide exposed adhesive 28 on the longitudinal surfaces 22.

In the preferred embodiment the adhesive layer 28 is separated from the interior of the container 10 by a peelable protective film 30. The protective film or cover 30 is utilized to prevent the adhesive layer 28 from drying or becoming contaminated prior to use. When it is time to utilize the container 10 the protective film or cover 30 is peeled back and removed to expose the adhesive layer 28. The freshly peeled adhesive is contamination free.

In the illustration of FIG. 1 the adhesive layer 28 on the upper member 12 is shown as totally exposed while the peelable film 30 is shown as still attached to the greater part of the layer 28 deposited on the lower member 14. In actual use, all segments of the adhesive layer 28 will be exposed.

An air space 32 is formed between the adhesive layer 28 and the article 16. This is caused by the support of the article 16 by the spacer blocks 24. The air space 32 prevents the surface of the article 16 from contacting the adhesive layer 28. The purpose of the adhseive layer 28 is to capture and return particulate matter which may exist within the air space 32. This prevents particulate contamination to the surface of the article 16.

Figure 2:
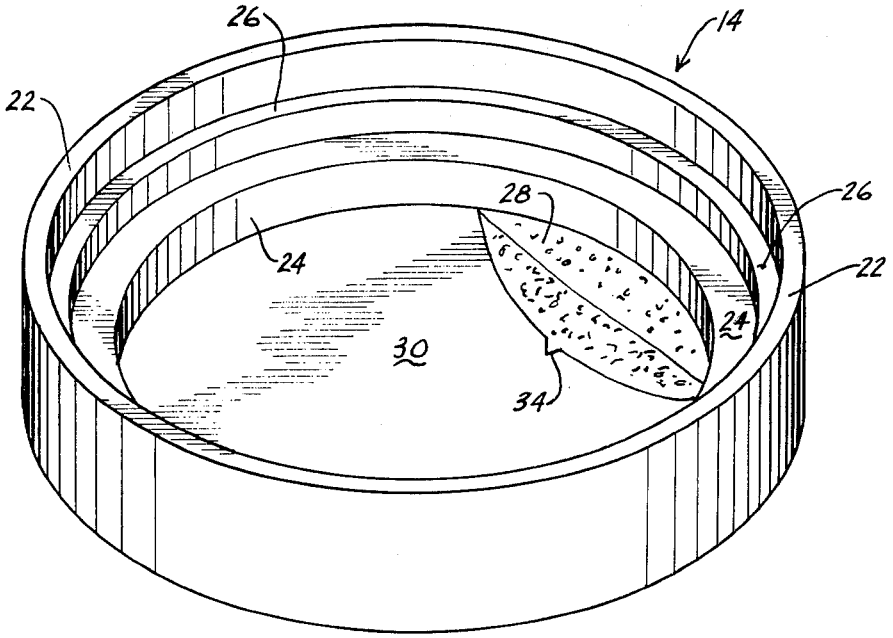
FIG. 2 is a perspective view of the bottom member of the dustless package of FIG. 1.

FIG. 2 illustrates the lower member 14 of the container 10 shown apart from the top member 12. This perspective view illustrates the particular shape of the lower member 14 selected for use in packaging a photomask pellicle. Since the pellicle is circular in shape with a support ring on the outside and a film or membrane stretched across the support ring, this sort of packaging is particularly appropriate. In this case it may be seen that the spacer block 24 is in the form of a continuous ring while the spacer ledge 26 is a portion of the ring extending longitudinally from the block 24. The dimensions of the elements are selected such that the pellicle fits tightly into the container and does not slide from side to side.

In this illustration it may be seen that the peelable cover 30 is partially peeled back to expose a section of the adhesive layer 28. As shown, the peelable cover 30 is provided with a grasping extension 34 at one edge so it may be easily grasped and removed from the adhesive layer 28. The removal of the protective film 30 may be accomplished either by manual or mechanical means.

The method of the present invention can be readily adapted to various types of containers utilized to package contamination sensitive materials. The initial step in the processs is to fit or retrofit appropriate spacer blocks or rings into the container in such a manner that the articles are suspended within the container and do not come into contact with the interior container surfaces. The exposed interior surfaces, with which the article does not come into contact, are then provided with the adhesive layer. After the adhesive layer has been applied a protective film or cover is then placed over the adhesive layer to keep it in a pristine state until it is ready for use.

One modification of the method may be to coat the entire interior of the container with the adhesive layer. The adhesive may then be used to cement the spacer blocks 24 or rings in place.

One good method of accomplishing this is to apply precut double sided adhesive tape to the enire interior of the frame 18 and then to insert the spacer blocks 24.

There is no requirement restricting the application of adhesive to the lateral surfaces of the container. Any surface with which the product does not come into contact may be provided with adhesive. A maximum surface area of exposed adhesive acts to minimize the amount of particulate contamination which may be present in the air spaces and on the articles within the continer.

The selection of material for dustless packages constructed according to the method of the present invention utilizes predominantly conventional materials. The materials utilized in the exterior frame must have a high surface integrity such that they do not provide any particulate contamination to the interior of the container. They must also be sufficiently strong and rigid to protect the contents from impact during transport stacking and storage. The materials and formation of materials must also be selected such that an adequate seal is created where the portions of the container are juxtaposed. This is important so that no contamination may enter the interior of the container from the surrounding environment.

The spacer blocks and ridges selected must also have high surface integrity, protect the product against impact, and prevent the product from coming into contact with any of the adhesive covered interior surfaces of the container. Any of numerous readily available commercial spacing materials, such as polyethylene, acrylics or aluminum, may be adequate for this purpose.

The preferred contact adhesive must also have various properties. Initially, it needs to be sufficiently sticky that it captures and retains as high a percentage as possible of particulate matter which may be trapped within the interior of the container. The adhesive must also have significant spatial integrity such that it will remain in position and will not break off or flake and become a contaminant in itself. Furthermore, the adhesive must be such that it will retain its integrity over long use and during transportation and storage conditions. It is imperative that the adhesive not dry up and flake or lose its capture and retention properties during usage. Acceptable contact adhesives include double sided pressure sensitive adhesives from various commercially available sources such as 3M Company's 3M447 adhesive.

The cover sheet or film 30 must be selected such that its easily applied and removed from the adhesive layer 28 without adversely affecting the integrity of the adhesive layer. The dimensions of the cover sheet 30 are selected to match the dimensions of the exposed adhesive layer precisely and, in some embodiments, a grasping extension 34 is provided for easy removal. Since a chemical cleaning technique may be utilized on the container immediately prior to use it is important that the cover 30 protect the adhesive 28 from degradation during cleaning. A preferred material for the cover film 30 has been found to be mylar.

The dimensions of a container 10 according to the method of the present invention are entirely dependent upon the articles 16 to be contained within. Except as provided above, no unusual materials or procedures are required to implement the method.

Although the present invention has been described above in terms of the best presently known mode of carrying out the method of the invention, those skilled in the art will readily recognize numerous modifications and alterations which may be made while retaining the teachings of the invention. Accordingly, the above disclosure is not to be construed as limiting. The appended claims are therefore to be interpreted as encompassing the entire spirit and scope of the invention.

INDUSTRIAL APPLICABILITY

The method of the present invention and the containers manufactured according to the method are expected to have widespread industrial utility within the electronic and optical fields. In particular, the method is adapted for immediate utility in the packaging of photomask pellicles. It is also expected that it will be rapidly adapted for usage regarding shipment and storage of materials which must be prevented from particulate contamination and which are difficult or impossible to adequately clean prior to usage.

Since the method of the present invention can be easily implemented as an addition to the present packaging techniques, it is expected to have widespread acceptance. Containers according to the method of the present invention will involve minimal additional manufacturing complexity of expense and thus should compete very favorably with prior art containers. For all of the above reasons, it is expected that the present invention will have significant industrial applicability at present and in the future.

I claim:

1. A method for providing a substantially dustfree interior to a sealed container, in steps comprising:

a. installing spacing means within the container such that the article or articles placed therein are separated from at least a portion of the interior surfaces of the container, the spacing means being selected to provide no loose particulate matter; and b. coating the exposed non-article-contacting interior surface of the container with a layer of contact adhesive.

2. The method of claim 1 wherein:

the total exposed surface area of the spacing means is less than the total surface area of the exposed interior surface of the container.

3. The method of claim 1 and further including the step of:

c. providing a peelable cover over the contact adhesive, the peelable cover being adapted such that it protects the adhesive while in place and further being adapted for easy removal at the time that articles are to be placed within the container.

4. The method of claim 3 wherein:

the total exposed surface area of the spacing means is less than the total surface area of the exposed interior surface of the container.

5. The method of 3 wherein:

the spacing means are semirigid blocks formed to conform to the outside shape of the articles being contained.

6. The method of claim 1 wherein:

the article to be contained is a circular photomask pellicle and the spacing means are selected to be upper and lower support rings.

7. The method of claim 1 wherein:

said contact adhesive is selected to be resistant to drying, degradation and saturation during storage and shipment conditions.

8. The method of claim 1 wherein:

said contact adhesive is selected to be 3M 447.

9. The method of claim 3 wherein:

said peelable cover protects and covers all of the exposed contact adhesive.

10. The method of claim 3 wherein:

said peelable cover is further provided with a grasping extension such that it may be readily grasped by manual or mechanical means and removed from the adhesive.

11. A dustless container for packaging one or more articles comprising:

a first frame member;

a second frame member adapted to mate with the first frame member to form a sealable enclosed volume therewithin;

spacing means for preventing the articles from contacting the interior surfaces of the first and second frame members; and a layer of contact adhesive applied to at least some of the surfaces of the first and second frame members which are exposed within said enclosed volume.

12. The dustless container of claim 11 wherein:

the spacing means include semirigid blocks, formed to mate with the exterior portions of the enclosed articles, bonded to the interior surfaces of the first and second frame members.

13. The dustless container of claim 11 wherein:

the surface area of said exposed contact adhesive is greater than the combined exposed surface area of the spacing means.

14. The dustless container of claim 11 and further comprising:

peelable covers applied over the exposed portion of said contact adhesive so as to protect said adhesive from contamination prior to use, said peelable covers being adapted for easy removal to expose said adhesive immediately prior to insertion of articles into the container.

15. The dustless container of claim 11 wherein:

said peelable covers are provided with a grapsing extension for easy removal.

16. The dustless container of claim 11 wherein:

said contact adhesive is selected to be resistant to drying, degradation and saturation during storage and shipment conditions.

17. The dustless container of claim 11 wherein:

said contact adhesive is 3M 447.

18. The dustless container of claim 11 wherein:

said contact adhesive is in the form of double sided adhesive tape.

19. The method of claim 1 wherein:

said contact adhesive is in the form of double sided adhesive tape.

* * * * *